US005853090A

United States Patent [19]

Brozak, Jr.

[11] Patent Number: 5,853,090

[45] Date of Patent: Dec. 29, 1998

[54] CONVERTIBLE RETAIL PRODUCT DISPLAY COLUMNS AND SYSTEMS

[75] Inventor: Emory N. Brozak, Jr., Strongsville, Ohio

[73] Assignee: American Greetings Corporation, Cleveland, Ohio

[21] Appl. No.: 688,408

[22] Filed: Jul. 30, 1996

[51] Int. Cl.[6] ..... A47F 7/00

[52] U.S. Cl. ..... 211/13.1

[58] Field of Search ..... 211/13.1, 163

[56] References Cited

U.S. PATENT DOCUMENTS

| | | |
|---|---|---|
| 4,614,272 | 9/1986 | Shelton et al. . |
| 4,779,938 | 10/1988 | Johnston . |
| 5,052,563 | 10/1991 | Camp . |
| 5,054,624 | 10/1991 | Camp . |
| 5,257,703 | 11/1993 | Ascik et al. . |
| 5,280,839 | 1/1994 | Crampton . |
| 5,316,153 | 5/1994 | Crawford et al. . |

FOREIGN PATENT DOCUMENTS

| | | | |
|---|---|---|---|
| 2648030 | 6/1989 | France | 211/85.1 |

*Primary Examiner*—Alvin Chin-Shue
*Assistant Examiner*—Sarah Purol
*Attorney, Agent, or Firm*—Calfee, Halter & Griswold LLP

[57] ABSTRACT

Convertible retail product display columns and related systems are described which enable different types of products to be displayed and/or stored on a single display structure. Convertible retail product display columns include a plurality of panels wherein one panel is adapted to support a product of one type, and a second panel is adapted to support a product of a different type. Convertible retail product display systems include a plurality of vertically oriented rotationally mounted display columns supported by a frame structure, whereby the multiple panels of each of the display columns can be selectively oriented to simultaneously display and store different products.

18 Claims, 9 Drawing Sheets

CONVERTIBLE RETAIL PRODUCT DISPLAY COLUMNS AND SYSTEMS

FIELD OF THE INVENTION

The present invention pertains generally to product display for displaying consumer products in a retail environment and, more particularly, to retail displays for relatively small articles such as eyewear and jewelry.

BACKGROUND OF THE INVENTION

Retail displays are critical to the sales of consumer products as they are the means by which products are positioned in the view and reach of prospective purchasers. Product displays are therefore configured to hold and position as much product as possible in the view of consumers in an orderly and appealing arrangement. To this end, a great variety of product display racks and product support devices have been contrived for all types of products. As the number of different types of displays multiplies, greater amounts of store space is occupied to the extent that not all displays can be on the sales floor at the same time. For seasonal items such as sunglasses, display racks are moved about a store throughout the year, according to demand and sales results. In many stores seasonal display racks are placed in storage during a product's off-season. In large stores, this can lead to permanent misplacement of some display racks and the inventory carried thereon.

Some attempts have been made to accommodate a variety of products on a single structure, such as described by U.S. Pat. Nos. 5,052,563 and 5,054,624, in the form of jewelry caddies having hanger arms and panels to support different types of jewelry. The structures, however, are not disclosed for use in retail point-of-sale applications and do not utilize multiple sided columns whereby one type of product is displayed or exposed while a different type of product is concealed. And U.S. Pat. No. 4,614,272 describes a device for displaying sunglasses in which sunglasses are arranged back-to-back in specifically constructed display columns not adaptable for simultaneous support of products dissimilar to sunglasses such as jewelry. Thus, the need to consolidate and increase the product density and diversity of display racks exists, along with the desire to avoid having to move displays about a store in accordance with seasonal demand of products.

SUMMARY OF THE INVENTION

The present invention overcomes these and other disadvantages of prior art retail product displays by providing multiple-sided vertically oriented display columns rotationally mounted for selective exposure of different panels which support different types of products. The inventive display columns and display systems which include a plurality of the display columns, two different products, such as eyewear and jewelry, can be displayed and/or stored by the same display structure. Among the many display and storage combinations possible with the invention, the display can be configured to display exclusively one type of product while storing a different type of product completely concealed from view, or simultaneously display and store two different types of products.

In accordance with one aspect of the invention, a convertible retail product display column includes a first panel adapted to support a first type of product, a second panel adapted to support a second type of product, an intermediate panel connecting the first and second panels, and a mounting rod attached to the display column and passing through a vertical axis of the display column whereby the display column is rotatable about a vertical axis for selective display of products on one of the panels.

In accordance with another aspect of the invention, a convertible retail product display column includes three intersecting panels with at least two of the panels adapted to support product display cards, and a mounting rod secured through a vertical axis of the display column whereby the display column can be disposed within a frame structure and rotated about a vertical axis.

In accordance with another aspect of the invention, a convertible retail product display system includes a plurality of convertible retail product display columns, each display column having a first panel and a second panel, the first panel adapted to display a first type of product, the second panel adapted to display a second type of product, the first and second panels interconnected by an intermediate member, a mounting rod attached to each display column and vertically journalled between end plates whereby each display column of the system is rotatable about a vertical axis for selective display of products supported on the panels, and simultaneous storage of products on panels not exposed to an exterior of the display system.

And in accordance with another aspect of the invention, a convertible retail product display system for displaying and/or storing two different types of products simultaneously or alternatively without removing either product from the system includes a plurality of primary display columns, each primary display column having a first panel adapted to display a first product, and a second panel adapted to display a second product, the first panel being opposed and generally parallel to the second panel, the first and second panels being connected together, a mounting rod connected to and passing through a vertical axis of the primary display column, at least one secondary display column having a plurality of interconnected panels and a mounting rod connected to and passing through a vertical axis of the secondary display panel, ends of the mounting rods inserted in top and bottom end plates disposed generally perpendicular to the display columns, the top and bottom end plates connected together by a frame, whereby each of the display columns is selectively rotatable about the vertical axis of the respective mounting rod.

These and other aspects of the invention are herein described in particularized detail with reference to the accompanying Figures which illustrate the preferred and alternate embodiments of the invention and the general principles and concepts of the invention which are all within the scope of the claims, plus equivalents.

DETAILED DESCRIPTION OF PREFERRED AND ALTERNATE EMBODIMENTS

Figure 1:
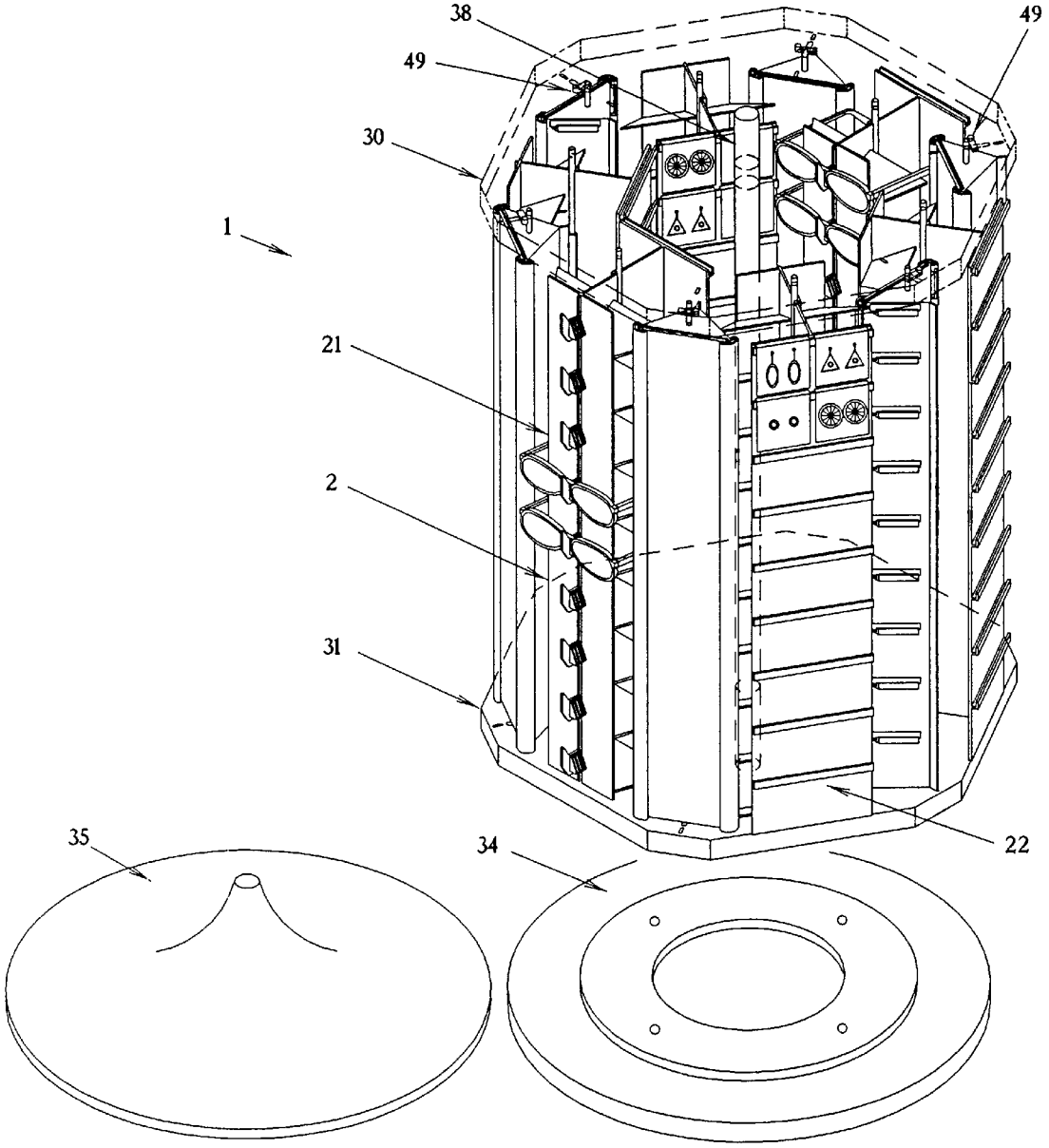
FIG. 1 is a perspective view of an embodiment of the Convertible Retail Product Display System of the invention which includes a plurality of Convertible Retail Product Display Columns of the present invention.
Figure 3:
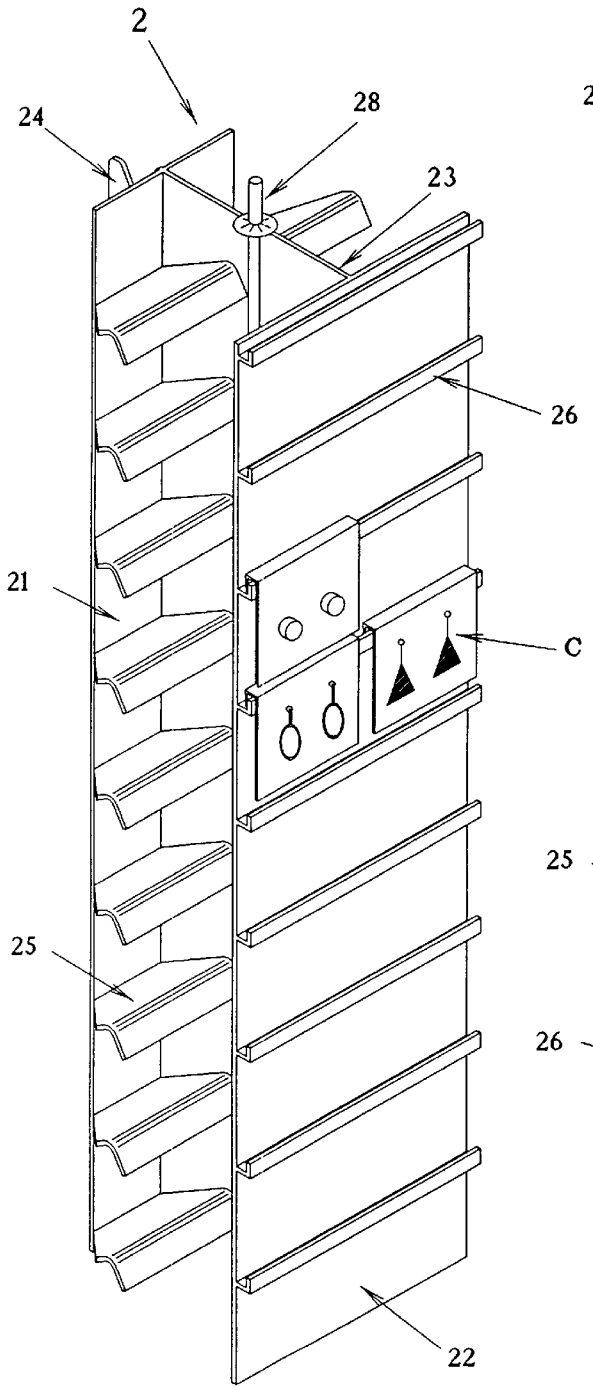
FIG. 3 is a perspective view of a Convertible Retail Product Display Column of the present invention.
Figure 2:
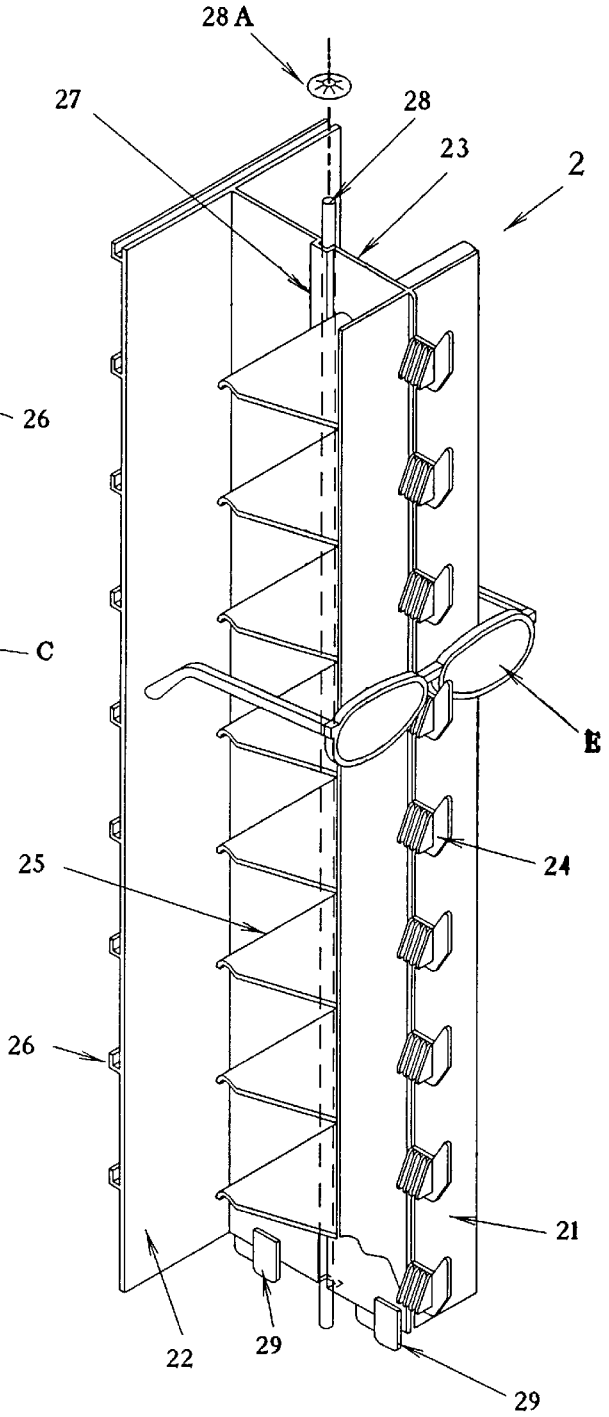
FIG. 2 is a perspective view of a Convertible Retail Product Display Column of the present invention.
Figure 4A:
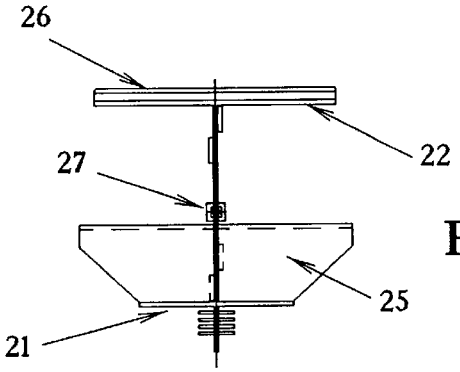
FIG. 4A is an top view of the Convertible Retail Product Display Column of the present invention.
Figure 4:
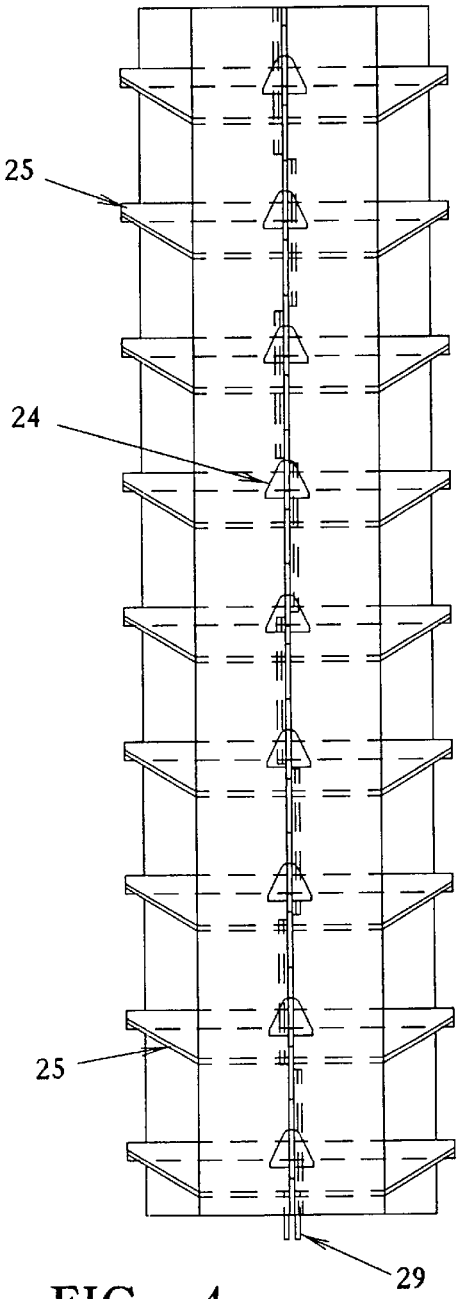
FIG. 4 is a front elevation view of one panel of the Convertible Retail Product Display column of the present invention.
Figure 5:
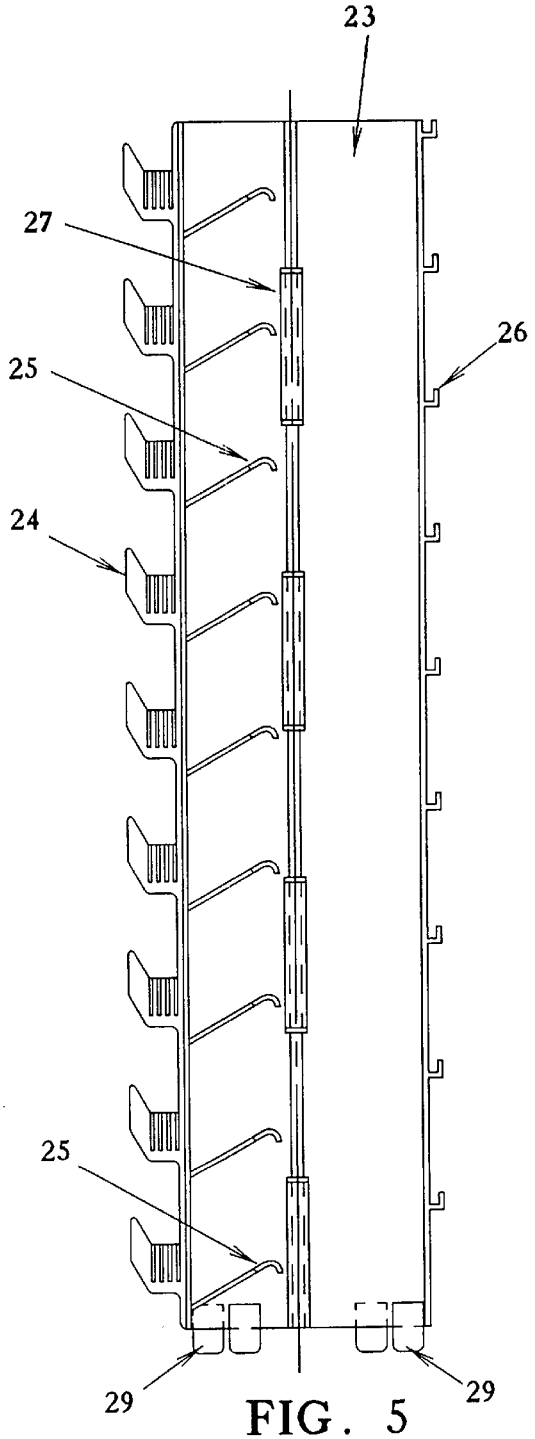
FIG. 5 is a side elevation view of the Convertible Retail Product Display Column of the present invention.

With reference to FIG. 1, an embodiment of a convertible retail product display system, constructed in accordance with the invention, is indicated generally at 1. This embodiment includes a generally circular array of convertible primary product support columns, indicated generally at 2, and also referred to herein as "primary columns 2". As shown in isolation in FIG. 2, each primary column 2 is made up of opposing panels 21 and 22, which are connected together by an intermediate member 23 oriented generally perpendicular to opposing panels 21 and 22, so that the cross-sectional configuration of the primary columns 2 is generally in the shape of the letter "I", as shown in FIGS. 2, 3, and 4A. The entire primary column 2 can be molded as a single piece with any suitable means for the interconnection of panels 21 and 22, so long as the panels are generally parallel and spaced apart a distance sufficient to accommodate the products to be supported on the panels, such as eyeglasses with the eyeglass arms in the opened position. As shown in FIGS. 2–5, panel 21 includes on one side a generally vertical array of eyeglass nose bridge supports 24, and on the opposite side a corresponding vertical array of eyeglass arm support wings 25. With this structure, pairs of eyeglasses E, such as sunglasses or reading glasses, can be positioned upon nose bridge supports 24 with the eyeglass arms in an open position to extend behind the face of panel 21 and rest upon wings 25. As shown in FIGS. 4 and 5, wings 25 are angled upward from below the corresponding nosebridge support to a point slightly below the elevation of the corresponding nosebridge support, to provide a guiding ramp for the eyeglass arm ear pads as a pair of eyeglasses is placed on the display column. In particular, the angled wings 25 facilitate stocking of the display and replacement of eyeglasses on the display by shoppers. For display of eyeglasses with the arms in the folded position, i.e., where the entire eyeglass product is supported by a nosebridge support structure, panel 22 would not have to be spaced from panel 21, but would still be connected to panel 21 and thereby within the scope of the invention.

Although the construction of panel 21 is described in connection with the support and display of eyeglasses, it is further within the scope of the invention that panel 21 could be alternately configured to support and display a product or products other than eyeglasses or sunglasses, and still different than the product or products supported and displayed by opposing panel 22.

As shown in FIG. 3, a vertical array of horizontal flanges 26, such as for example in the form of "J-hooks", extend from one side of panel 22 to provide a hanging point for a plurality of product display cards C, which have a lip across a top edge to engage and hang from flange 26. As is known in the art, cards C are most commonly used to support and display jewelry such as earrings, bracelets and necklaces, but which can also be used to support and display any product which is attachable to and able to be supported by card C and flange 26. Therefore, as used herein, the term "product" includes any and all such products able to be supported in this manner, and/or in the manner of the described nosebridge/wing supports.

Figure 7:
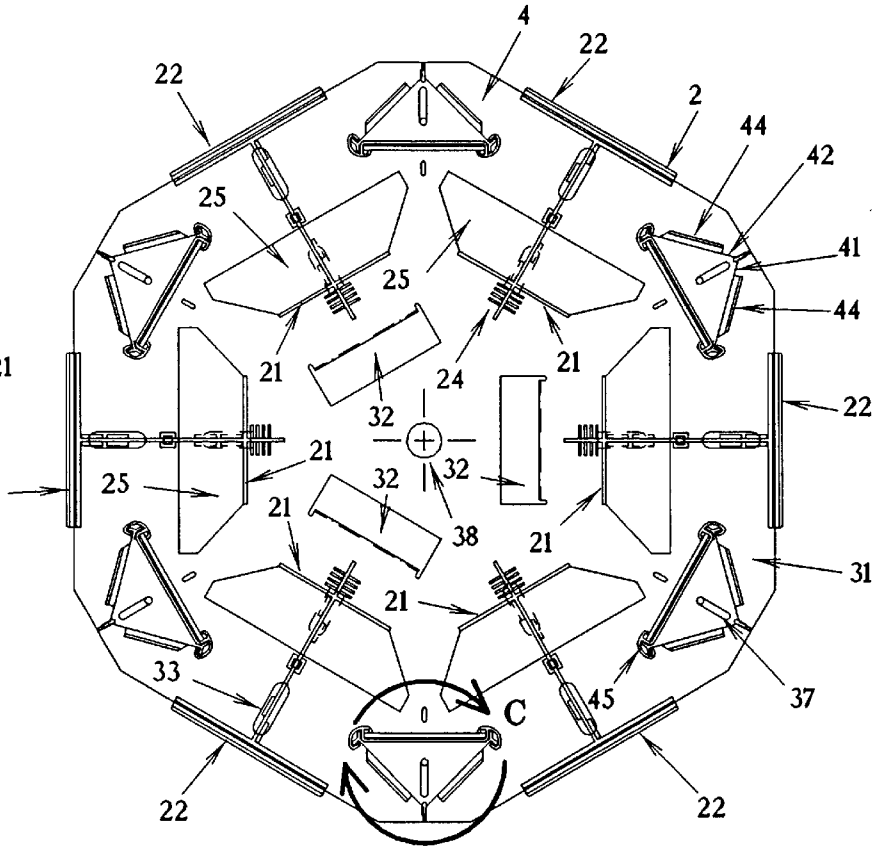
FIG. 7 is a top view of an embodiment of a Convertible Retail Product Display System of the present invention in a selected display configuration opposite that of FIG. 6.
Figure 6:
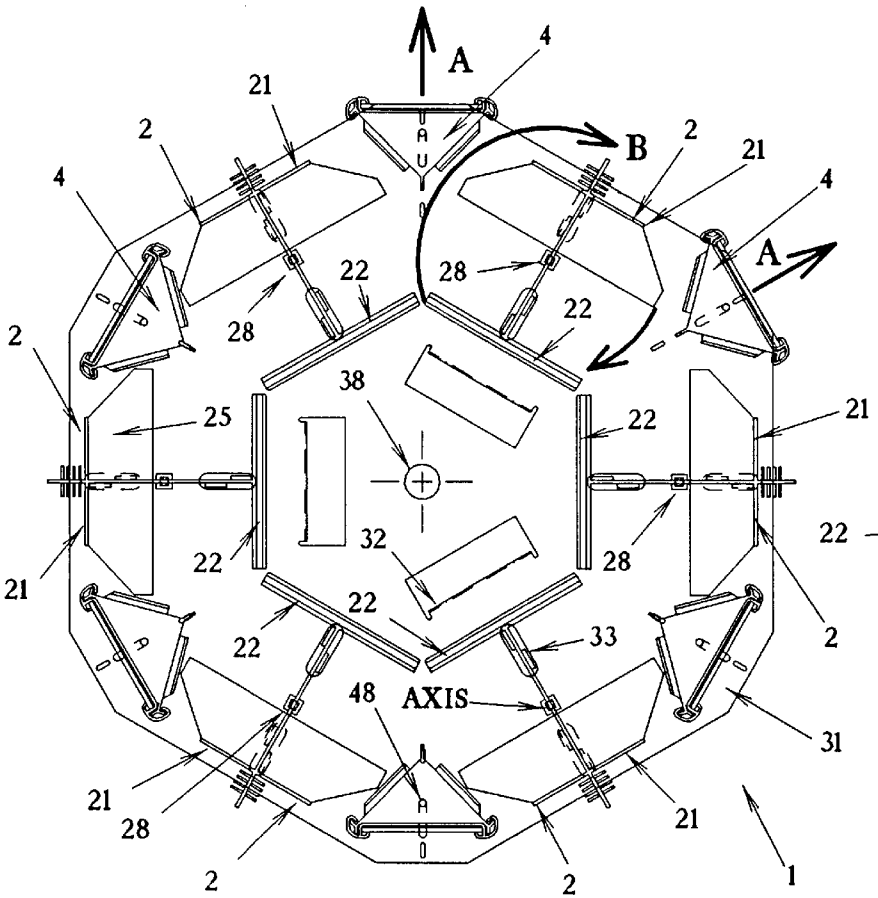
FIG. 6 is a top view of an embodiment of a Convertible Retail Product Display System of the present invention in a selected display configuration.

As further shown in FIGS. 2, 3, 4A and 5, the intermediate member 23 of the primary column 2 includes a channel 27 for receiving a mounting rod 28 which passes through a vertical axis of primary column 2 whereby the primary column 2 is rotatable about a vertical axis as defined by mounting rod 28. Mounting rods 28 are mounted or journalled for vertically oriented axial rotation between two generally horizontal parallel end plates, including top end plate 30 and bottom end plate 31, which are connected by a frame 32 and a central support rod 38, as shown in FIGS. 1, 6 and 7. Two or more display columns can be vertically stacked upon a mounting rod 28 or axially adjoined mounting rods to increase the height and density of the display. A mounting rod retainer or wire nut 28*a* is used on both ends of the mounting rods adjacent the plates 30, 31 to retain the display columns between the end plates and to retain multiple columns on the rod.

Figure 10:
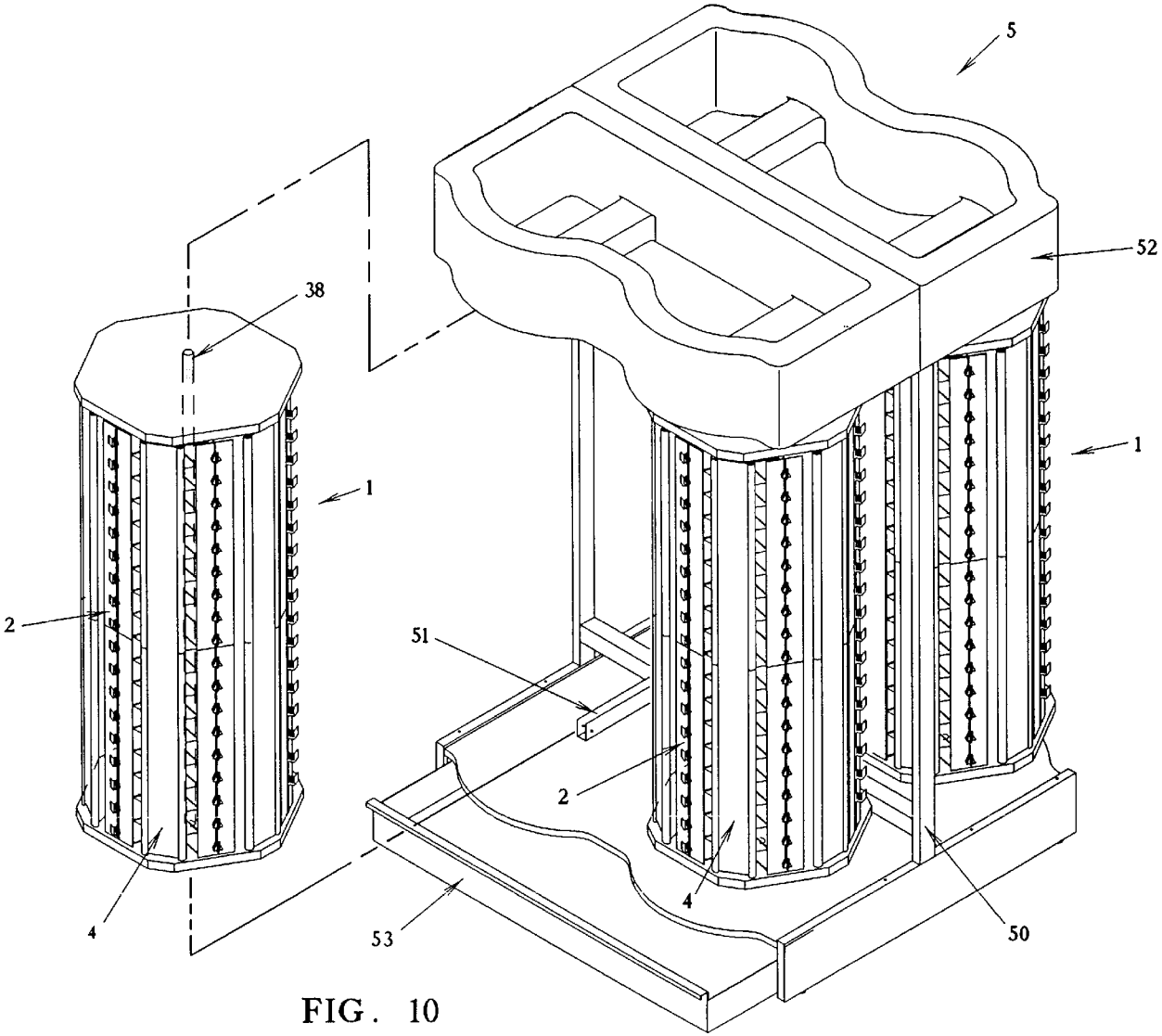
FIG. 10 is a perspective view of an alternate embodiment of a convertible Retail Product Display System of the present invention.

As shown in FIGS. 6 and 7, each primary column can be selectively positioned to orient either panel 21 or panel 22 to face radially outward from the center of the display system 1, with the corresponding opposing panel facing radially inward toward the center of the display system 1 and thereby completely concealed from view. FIG. 1 illustrates one possible configuration of the display system 1 wherein panel 21 of one display column 2 is exposed to the exterior of the display (with opposing panel 22 oriented toward the radial center of the display and thereby concealed), and panel 22 of another display column 2 exposed to the exterior of the display (with opposing panel 21 facing the radial center of the display and thereby concealed from view). Alternatively, FIGS. 6 and 10 illustrate display systems 1 uniformly configured for display of eyeglasses with only panels 21 exposed and all panels 22 (including the products supported thereon) concealed from view. And FIGS. 7 and 11 oppositely configured with only panels 22 exposed and all panels 21 (and the products supported thereon) concealed from view. The inherent product display and storage flexibility of the convertible product display system is readily apparent from these Figures. The system allows merchandisers to select the type of product to be displayed while simultaneously safely storing a different type of product, without having to use two different types of displays, and without having to move displays around a store.

To hold the primary columns 2 in a selected display position or configuration, indexing tabs 29 (shown in FIGS. 2 and 5) are provided at the bottom of primary column 2 for insertion into corresponding slots 33 (shown in FIGS. 6 and 7) in bottom end plate 31 to fix the column in a selected display position. To change the orientation of any particular primary column 2, the column is simply lifted to disengage the indexing tabs 29 from the slots and rotated 180° about rod 28 whereat the indexing tabs are reinserted into the slots 33 in base end plate 31.

As shown in FIGS. 1, 6 and 7, a circular array of six primary columns 2 fit neatly within an outer perimeter of the display system 1 to form a generally cylindrical display wherein the bottom end plate 31 is mountable upon a counter top by attachment to a "lazy susan" type base 34 to provide a "spinner", or on a pedestal 35 for a floor display, or mounted on a free standing frame structure as described below with reference to FIGS. 10–12.

Figure 8:
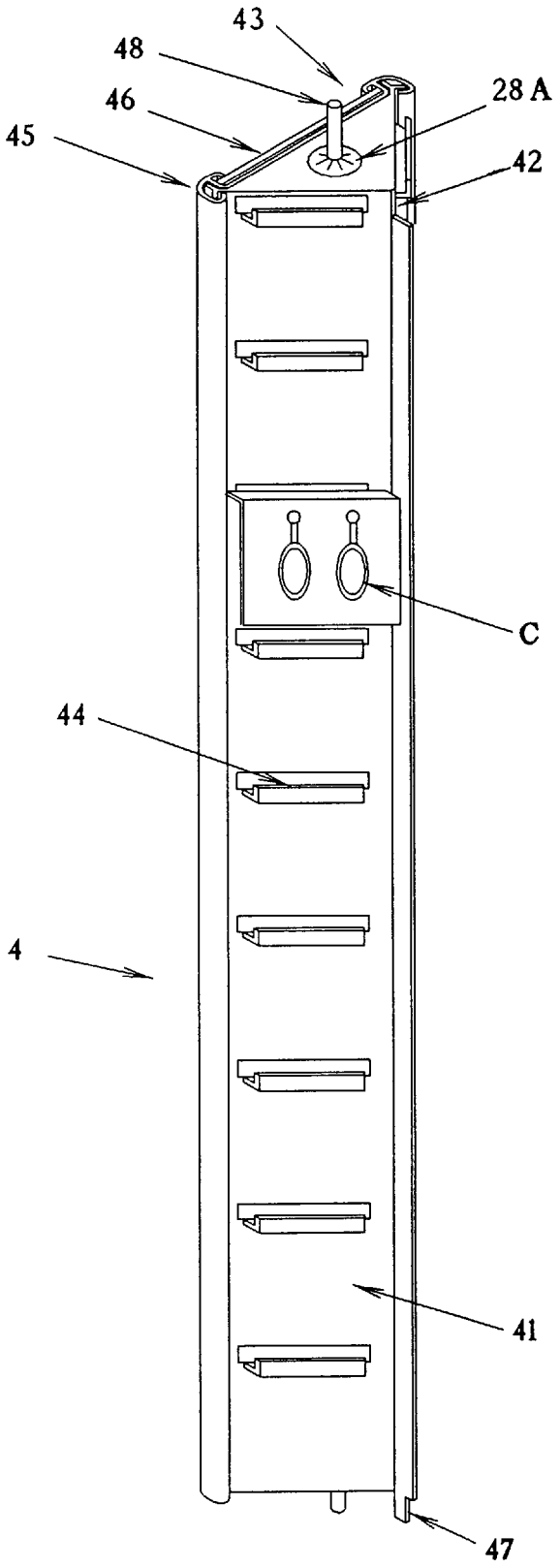
FIG. 8 is a perspective view of an alternate embodiment of a Convertible Retail Product Display Column of the present invention.
Figure 9A:
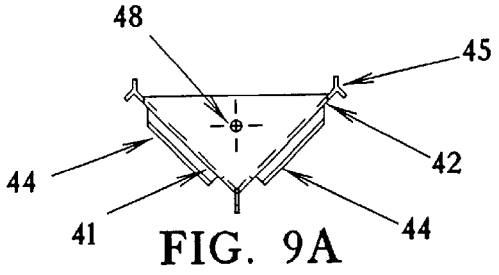
FIG. 9A is a top view of the Convertible Retail Product Display Column of FIG. 9.
Figure 9:
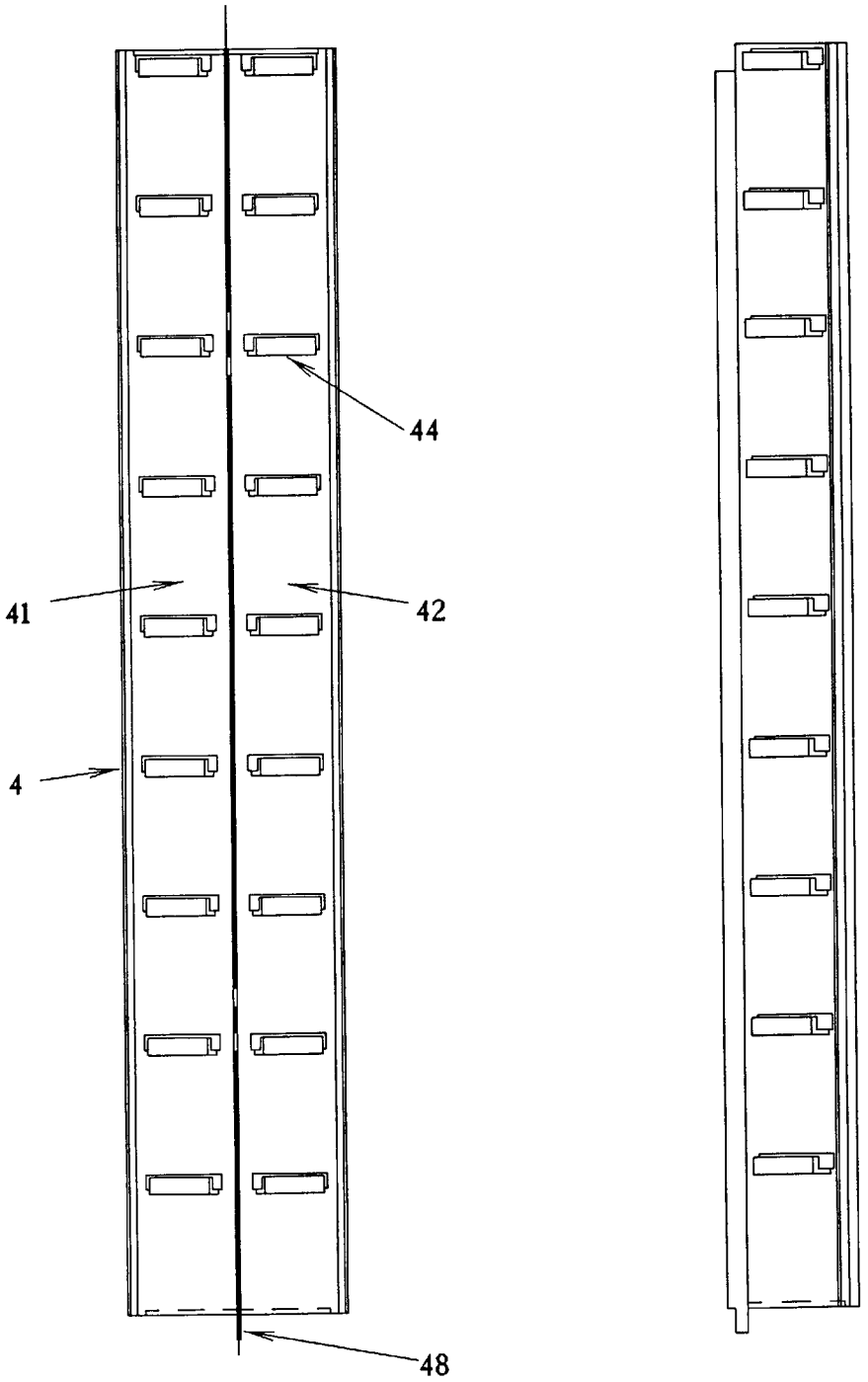
FIG. 9 is a side elevation view of the Convertible Retail Product Display Column of FIG. 8.

In the generally circular embodiments of the display system 1, as depicted in FIGS. 1, 6 and 7, secondary display columns 4, each having a generally triangular cross section shown in FIGS. 6, 7, 8 and 9A formed by three intersecting panels 41, 42 and 43, can be positioned between each primary display column 2 and similarly mounted by mounting rods 48 between the end plates for vertical axial rotation and selective orientation of the multiple panel sides. As shown in isolation in FIGS. 8, 9 and 9A, two side panels 41 and 42 of the secondary display columns 4 are configured with a vertical array of horizontal flanges or "J-hooks" 44 to provide hanging points for product display cards C. The third side panel 43 is provided with channels 45 for receiving a planar insert such as a mirror 46 or a placard such as advertising media. As shown in FIG. 8, an indexing tab 47 is provided at the bottom of secondary column 4 between side panels 41 and 42 for insertion into one of two indexing slots 33 in end plate 31. A mounting rod 48 which passes through the center of secondary column 4 is received in elongate mounting holes 37 (shown in FIGS. 6 and 7) in end plates 30 and 31 to allow the entire secondary column 4 to be rotated and radially shifted relative to the display center and then indexed to one of two display positions, either with side panels 41 and 42 oriented to face radially outward from the display center, or with the third side panel 43 oriented to face radially outward from the center of the display. A retainer latch 49 on top end plate 30, shown in FIG. 1, traverses each elongate mounting hole 37 to secure mounting rod 48 at one or the other end of hole 37.

To alter the configuration of a display system 1 having an array of both primary columns 2 and secondary columns 4, i.e., to convert any or all of the display columns 2 or 4 from exposure of one display panel or panels to another, a secondary column 4 is first lifted vertically along the axis of mounting rod 48, and then shifted radially outward (in the direction of arrow A in FIG. 6) to the outer end of mounting holes 37 (following release of retainer latch 49). With the secondary columns 4 on both sides of a primary column 2 shifted radially outward, the primary column 2 therebetween is provided sufficient radial clearance to be rotated 180° about mounting rod 28 (for example in the direction of arrow B in FIG. 6, or in the opposite direction) to expose the opposite display panel. Once the primary columns 2 are thus selectively oriented and re-indexed in slots 33, the secondary columns 4 are rotated to a selected position (for example in the direction of arrow C in FIG. 7, or in the opposite direction) and then shifted radially inward to re-engage the indexing tabs. Retainer latch 49 is put back into a locked position which prevents travel of the tip of mounting rod 48 in elongate hole 37.

Figure 11:
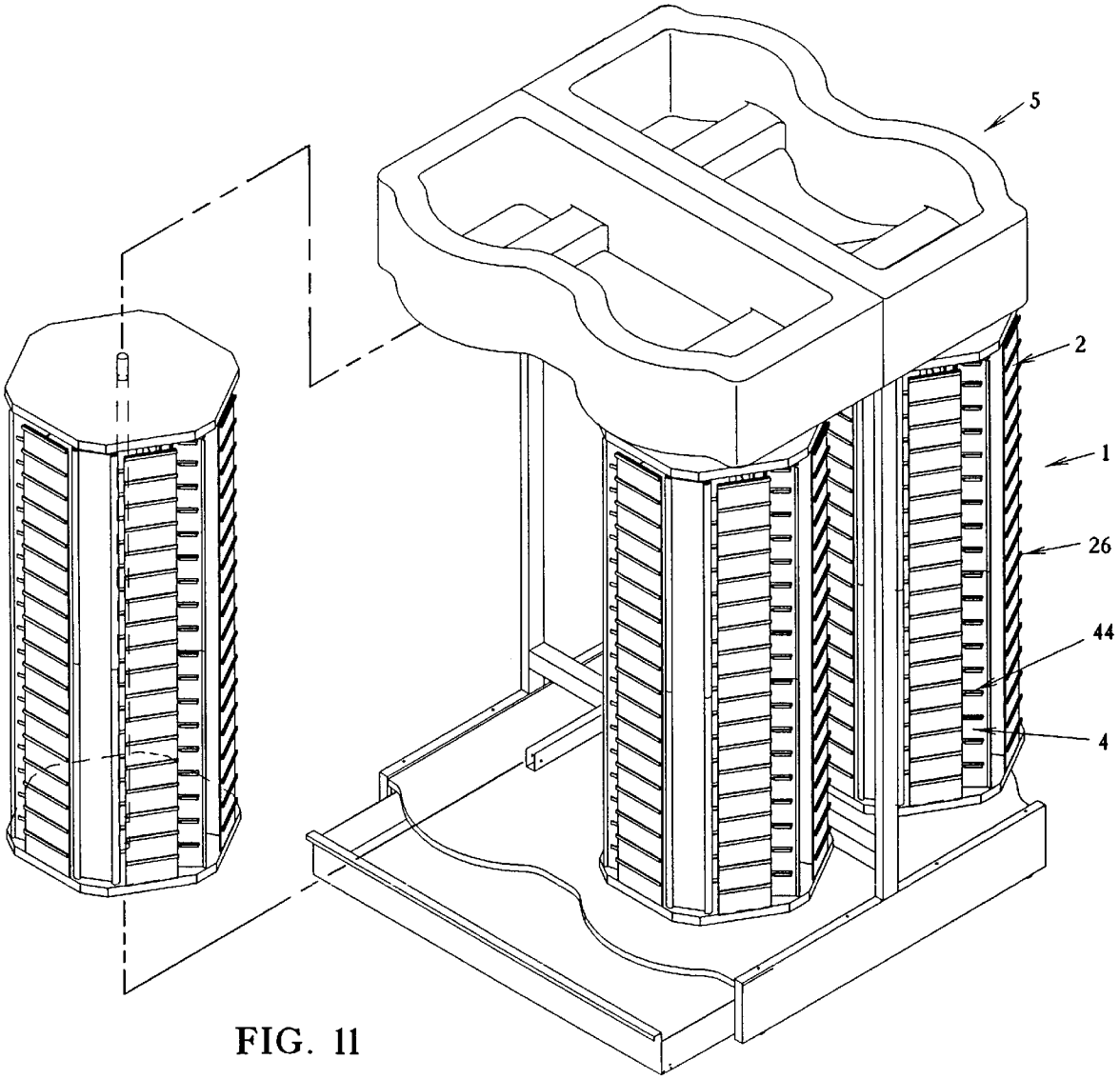
FIG. 11 is a perspective view of the Convertible Retail Product Display System of FIG. 10 in a different configuration.

FIGS. 10 and 11 illustrate an alternate embodiment of a convertible retail display system 5 made up of a plurality of convertible display systems 1 described above. A floor based frame 50 includes generally parallel cross-members 51 which provide attachment points for the center mounting rods 38 of each display system 1. A canopy or header 52 can be molded or otherwise fabricated to fit on the top of frame 50 as a decorative cap which may also carry advertising media. Inventory storage drawers 53 or cabinets may be incorporated into the base of frame 50. The display system 5 of FIG. 10 is shown uniformly configured to display eyeglasses, while storing card-supported products. The display system 5 of FIG. 11 is uniformly configured to display card-supported products, while storing eyeglasses.

Figure 12:
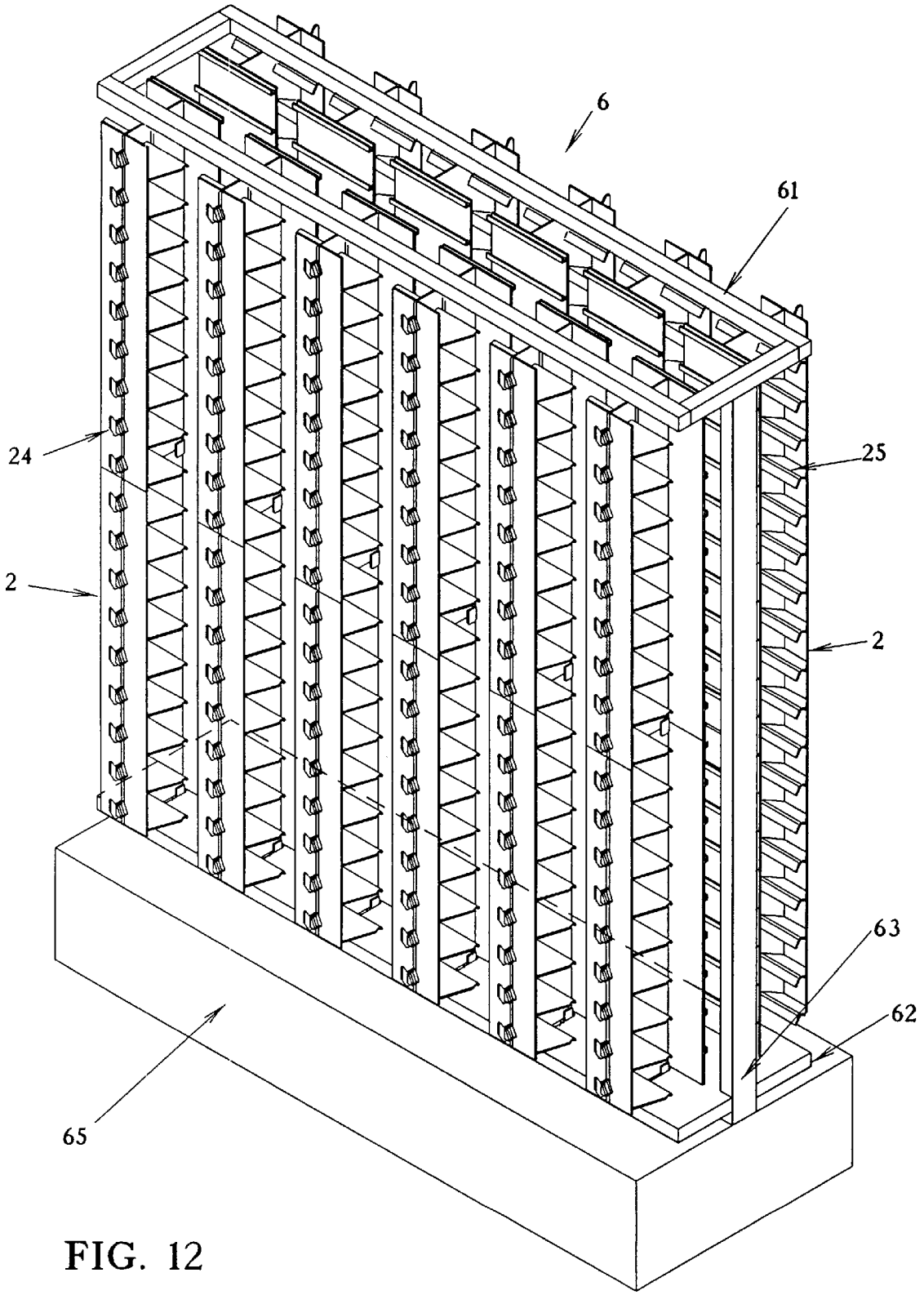
FIG. 12 is a perspective view of an alternate embodiment of the convertible Retail Product Display System of the present invention.

FIG. 12 illustrates an alternate embodiment of a display system, indicated generally at 6, made up of a plurality of primary columns 2 in a generally linear and back-to-back arrangement. In this embodiment (which does not include any secondary columns 4), sufficient radial clearance is provided between each primary column 2 to allow each to be axially rotated to change the panel orientation as described above. A top end panel 61 (shown in phantom) supported by frame structure 63, provides alignment holes for mounting rods 28 (not shown), which are similarly journalled in a bottom end plate 62. A base 65 serves to elevate the entire display off the floor. Inventory storage compartments in the form of drawers or cabinets may be incorporated into the base 65.

Although the invention has been described with specific reference to certain preferred and alternate embodiments, the basic principles and concepts of the invention, including a convertible merchandise display which is adaptable to display and store two different types of products, is executable in many variations, including alternate configurations of the panels of the primary and secondary columns to support different types of products, and alternate arrangements and combinations of the primary and secondary columns to form a display system. All such alternate arrangements and embodiments are within the scope of the invention as defined by the claims and equivalents thereto.

What is claimed is:

1. A convertible retail product display column comprising:

a first panel having a structure having nosebridge supports for supporting eyeglasses, and wings which extend from a side of the first panel opposite the nosebridge supports wherein said wings are angled upward from below the corresponding nosebridge support to a point below the elevation of the corresponding nosebridge support;

a second panel having a structure having a plurality of flanges which extend outward from a face of the second panel for supporting product display cards, and an intermediate member connecting the first panel to the second panel.

2. The convertible retail product display column of claim 1 further comprising a mounting rod oriented for vertical axial rotation of the convertible retail product display column.

3. The convertible retail product display column of claim 2 wherein the mounting rod is attached to the intermediate member.

4. The convertible retail product display column of claim 1 wherein the first and second panels are generally parallel.

5. The convertible retail product display column of claim 2 wherein the intermediate member further comprises a channel for receiving the mounting rod.

6. The convertible retail product display column of claim 1 further comprising indexing tabs whereby rotation of said column is prevented.

7. The convertible retail product display column of claim 1 having a cross-sectional configuration generally in the form of the letter I.

8. A convertible retail product display column comprising:

three panels each vertically oriented and intersecting so that the display column has a generally triangular cross-section, at least one of said panels having a plurality of horizontal flanges adapted to support product display cards, and a mounting rod secured through an elongate mounting hole, of the display column whereby the display column can be disposed within a frame structure and rotated about the mounting rod.

9. The convertible retail product display column of claim 8 further comprising indexing tabs.

10. A convertible retail product display system comprising:

a plurality of convertible retail product display columns, each display column having a first panel and a second panel, the first panel comprising a plurality of nose bridge supports and eyeglass arm support wings adapted to support eyeglasses wherein said wings are angled upward from below the corresponding nosebridge support to a point below the elevation of the corresponding nosebridge support, the second panel comprising a plurality of flanges adapted to support product display cards, the first and second panels interconnected by an intermediate member, a mounting rod attached to each display column and generally vertically oriented, the convertible retail product display system further comprising top and bottom end plates connected together, and ends of each mounting rod of each display column inserted in said end plates, whereby each display column is rotatable about the mounting rod between the end plates.

11. The convertible retail product display system of claim 10 wherein the plurality of display columns are in a generally circular array about a center end plate support rod.

12. The convertible retail product display system of claim 10 further comprising a frame for supporting the top and bottom end plates.

13. The convertible retail product display system of claim 10 wherein the plurality of display columns are in a generally linear array.

14. The convertible retail product display system of claim 10 wherein the mounting rod of each display column is attached to the intermediate member.

15. The convertible retail product display system of claim 10 wherein selected ones of the plurality of display columns are configured with the first panel exposed to an exterior of the display system, and the remainder of the display columns are configured with the second panel exposed to an exterior of the display system.

16. The convertible retail product display system of claim 10 further comprising a base attached to the bottom end plate.

17. The convertible retail product display system of claim 10 further comprising a canopy above the top end plate.

18. The convertible retail product display system of claim 10 further comprising at least one display column having three panels.

* * * * *